US006478080B2

(12) United States Patent
Pinto

(10) Patent No.: US 6,478,080 B2
(45) Date of Patent: Nov. 12, 2002

(54) FLUID COOLING DEVICE

(75) Inventor: Archibald E. Pinto, Fontana, CA (US)

(73) Assignee: Standard Motor Products, Inc., Long Island, NY (US)

( * ) Notice: Subject to any disclaimer, the term of this patent is extended or adjusted under 35 U.S.C. 154(b) by 0 days.

(21) Appl. No.: 09/819,739

(22) Filed: Mar. 29, 2001

(65) Prior Publication Data

US 2002/0139520 A1 Oct. 3, 2002

(51) Int. Cl.[7] ..... F28D 1/02

(52) U.S. Cl. ..... 165/153; 165/167; 165/DIG. 916; 184/104.3

(58) Field of Search ..... 165/916, 170, 165/109.1, 153, 167; 210/184, 186; 123/196 AB, 41.33; 184/104.1, 104.2, 104.3

(56) References Cited

U.S. PATENT DOCUMENTS 4,470,455 A * 9/1984 Sacca ..... 165/167
4,600,053 A * 7/1986 Patel et al. ..... 165/170
5,029,636 A * 7/1991 Kadle ..... 165/109.1
5,036,911 A * 8/1991 So et al. ..... 184/104.3
5,538,077 A * 7/1996 So et al. ..... 165/916
5,692,559 A * 12/1997 Cheong ..... 165/153
5,875,834 A * 3/1999 Brooks ..... 165/153
6,220,340 B1 * 4/2001 Cheong et al. ..... 165/916
6,289,982 B1 * 9/2001 Naji ..... 165/153

* cited by examiner

*Primary Examiner*—Henry Bennett
*Assistant Examiner*—Terrell McKinnon
(74) *Attorney, Agent, or Firm*—Bader and Bader; J. Walton Bader

(57) ABSTRACT

A fluid cooling device carrying cooling fins thereon also carries a plurality of series of plates one above the other. Each of the series of plates is composed of an upper and a lower plate which are in spaced relationship with one another. The space between the upper and lower plates of each of said series of plates define a channel therewithin which is connected to the corresponding channels in each of the series of plates with all of said channels being also connected to inlet and outlet openings. The portions of each of the plates within each of the channels defined therein carrying projecting baffles therewithin which are adapted to cause turbulence in the fluid to be cooled which passes through said channels from the inlet opening to the outlet opening of the device.

3 Claims, 8 Drawing Sheets

FLUID COOLING DEVICE

DISCUSSION OF THE PRIOR ART AS IT RELATES TO THIS INVENTION

Prior Art oil coolers are generally formed with a body portion having inlet and outlet means and a plurality of cooling elements operatively connected to said inlet and outlet means. The fluid to be cooled (generally oil) enters the inlet means, passes through the cooling elements and exits through the outlet means. The cooling is a continuous process. The pressure of the fluid is produced by pressure means such as an oil pump.

In order to increase the surface area of the fluid to be cooled the cooling elements are provided with baffles to induce turbulence within the fluid as the fluid passes through the cooling elements. These baffles, at the same time, increase the surface area of the fluid so as to enhance the rate of heat transfer from the fluid to be cooled to the cooling elements.

In the prior art structures, however, the baffle members are circular in cross section because of the ease of construction and the concomitant reduction in tooling costs. Baffles of non-circular cross section are more costly to produce than baffles of circular cross-section.

The present invention solves the problems involved by providing baffle members of substantially polygonal cross-section which, in turn, provides more efficient cooling and, at the same time, reduces the additional cost of the manufacture of such baffles by providing fewer cooling elements which thus require less material. Furthermore the polygonal baffle members of this invention also aid in allowing the flow of the fluid to be cooled when passing through the cooling elements to cause additional three dimensional turbulence while, at the same time, reinforcing the structure of the cooling elements to withstand the pressure exerted by the fluid passing through the channel within the cooling elements. Thus the cooling elements can be made light enough to provide adequate cooling but strong enough to support the pressure that they are subjected to. With the polygonal shape of the baffle members the surface area available for cooling the fluid involved is also increased therefore enabling a higher rate of heat exchange from the hot fluid to the cooling elements while the added turbulence and time for the portion of the hot fluid that is in direct contact with the cooling elements further enhances the rate of heat transfer. Thus the cooling device of this invention is more efficient than conventional cooling devices and is less costly to manufacture.

In the preferred embodiment of this invention the baffle members are offset from one another so as to increase the turbulence of the fluid to be cooled as it passes through the respective cooling element. The invention also includes novel constructional features which improve the device and make it easier to manufacture.

BRIEF DESCRIPTION OF THE INVENTION

The fluid cooling device of this invention is provided with oppositely disposed inlet and outlet channels each closed at one end thereof. A plurality of spaced cooling elements extend longitudinally between said inlet and outlet channels, with each of the cooling elements provided with a channel therethrough which is open at both ends thereof, one end of the channel in each cooling element communicates with the inlet channel and the opposite end of the channel within each of the cooling elements communicates with the outlet channel. A plurality of baffle members are disposed within the channel within each of the cooling elements and are adapted to cause turbulence within the said cooling element when a fluid under pressure passes therethrough. Each of the baffle members are substantially polygonal in cross-section and extend transversely across the channel within the respective cooling element so as to also provide support and prevent rupturing of said cooling element due to the pressure of the fluid passing therethrough.

In the preferred modification of this invention the baffle members are rectangular in shape having rounded corner portions and the cooling elements consist of a plurality of spaced series of longitudinal plates. Each member of each series of plates is formed with a pair of such plates disposed one above the other with the space between the said pair of plates defining a channel therethrough. The inlet and outlet channels are also defined by the structure of the aforesaid plates. The baffle members are integral with the plates involved.

The upstanding portions of the baffle members of one of the plates composing one member of each of such series of plates is in abutting relationship with the upstanding portion of the baffle members of the other plate of such series of plates.

The baffle members are adapted to cause turbulence within the third channels when a fluid under pressure passes therethrough. Each of the baffle members is substantially polygonal in cross-section and extend across said third channel. The baffle members also provide support and prevent rupturing of each of the plates due to the pressure of the fluid passing therethrough.

DETAILED DESCRIPTION OF THIS INVENTION

The invention will now be described in detail by reference to the accompanying drawings which are made a part of this specification.

FIG. 1 is a front view of an oil cooler of this invention.

FIG. 2 is a cross-sectional detail view, on an enlarged scale, showing one longitudinal end portion and associated structure of a first plate member of the series of plate members of this invention taken along lines 2—2 of FIG. 1. The opposite end portion of the said first plate member is shown in FIG. 7. This figure also shows the manner in which the fluid to be cooled passes from one end portion of the channel in the plate member through the plate member to the channel provided in the opposite end portion of the plate member.

Figure 7:
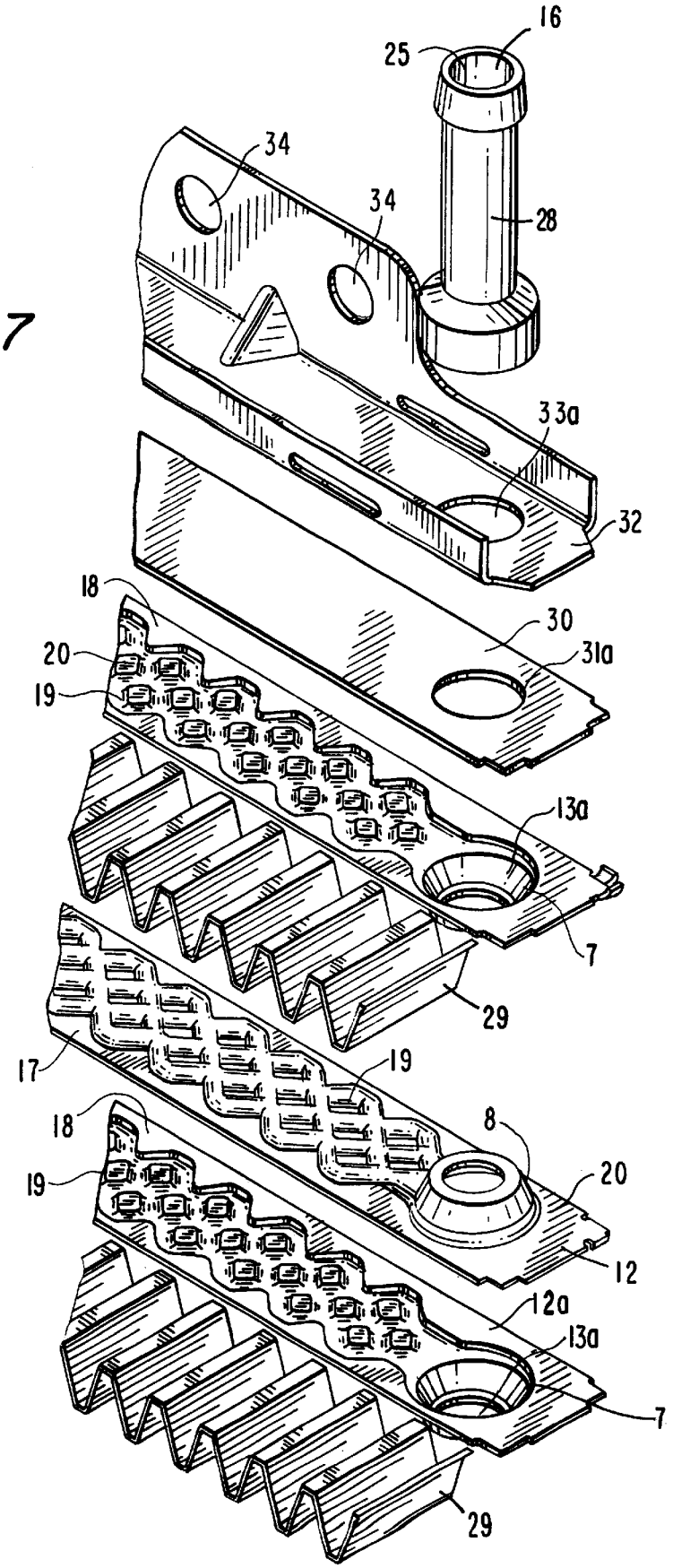

FIG. 7 is an exploded perspective view, on an enlarged scale, showing portions of the parts on one side of the cooling device of this invention. The opposite end portion of the parts are identical to the parts shown. The parts shown are not in assembled relationship with one another.

Figure 5:
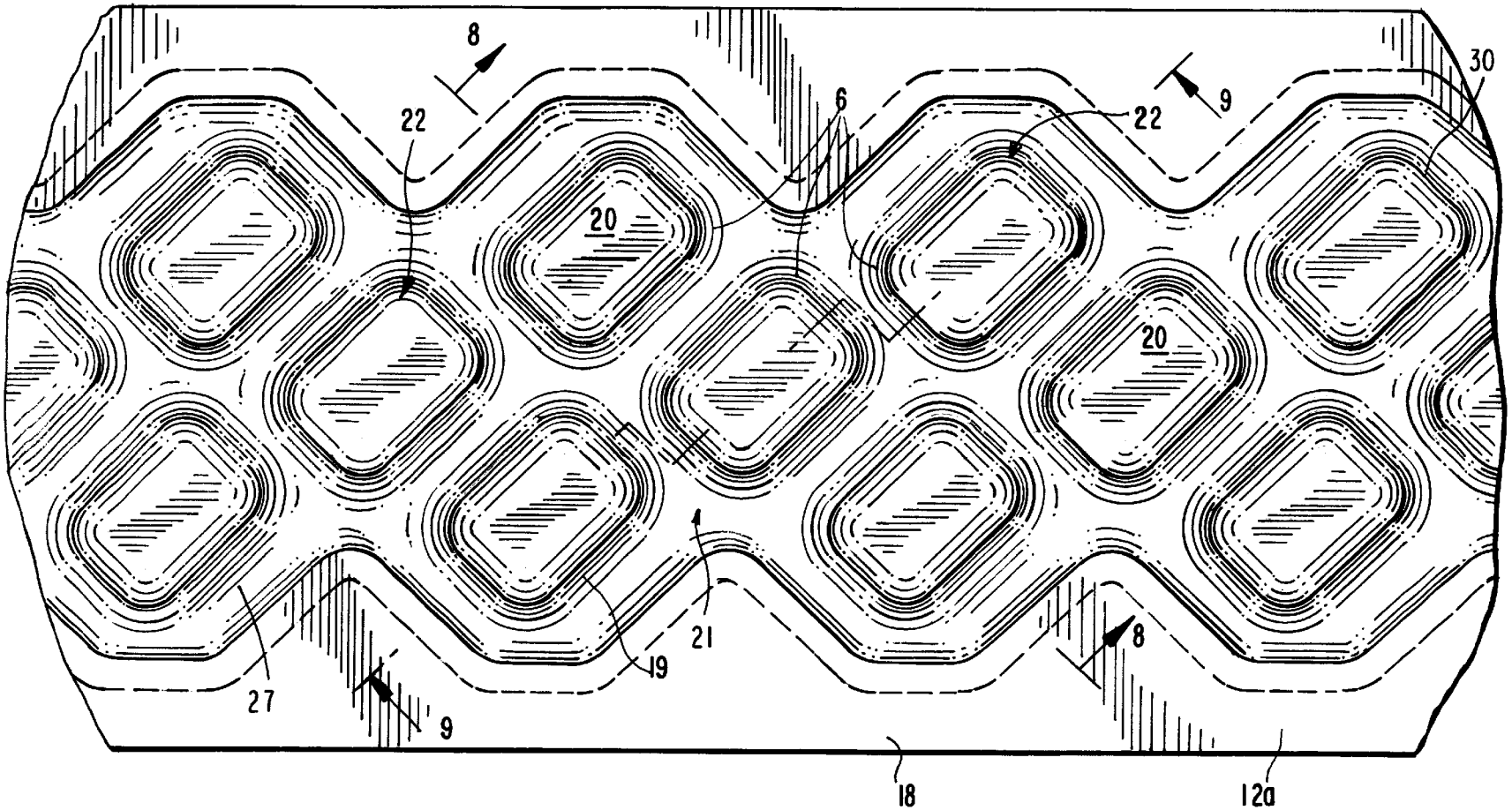
FIG. 5 is an enlarged detail view of a portion of the interior structure of a plate member taken along lines 5—5 of FIG. 1.
Figure 6:
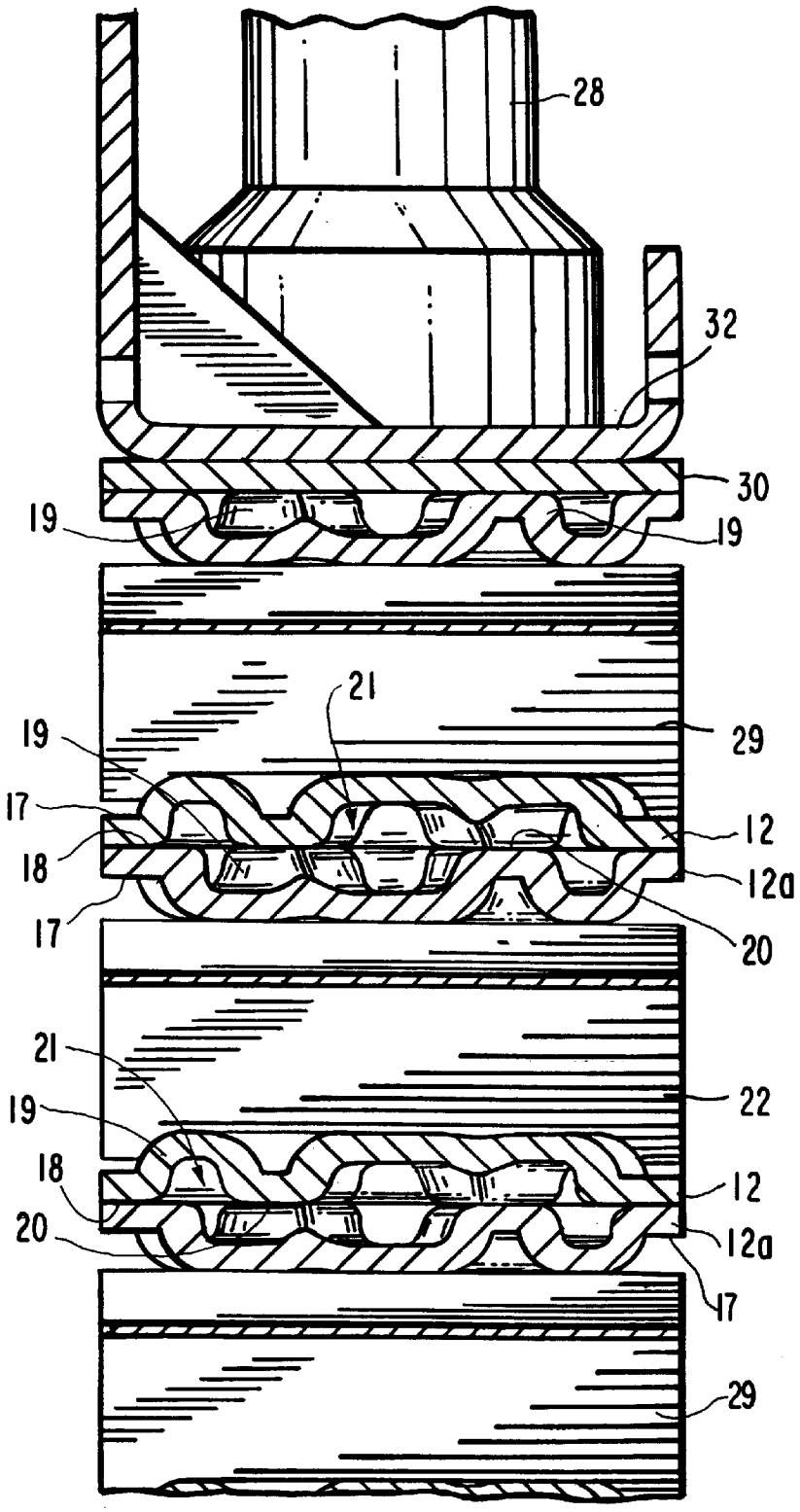
FIG. 6 is an enlarged fragmentary cross-sectional view taken along lines 6—6 of FIG. 1.
Figure 8:
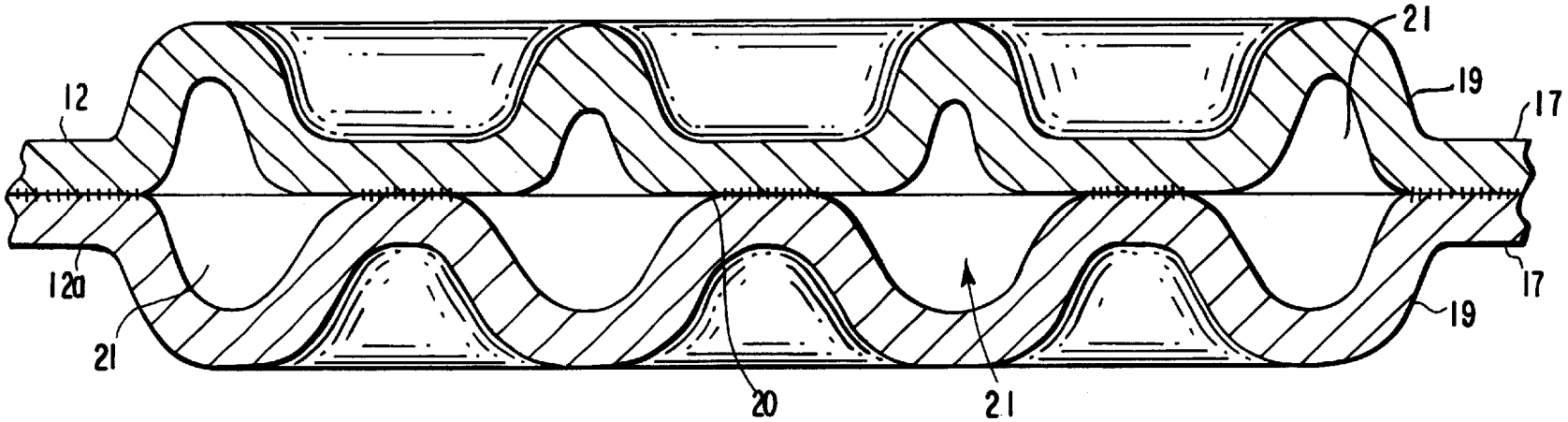

FIG. 8 is an enlarged detail cross-sectional view of a portion of the plates composing each of the series of plates of the cooling device of this invention taken along lines 8—8 of FIG. 5.

Figure 9:
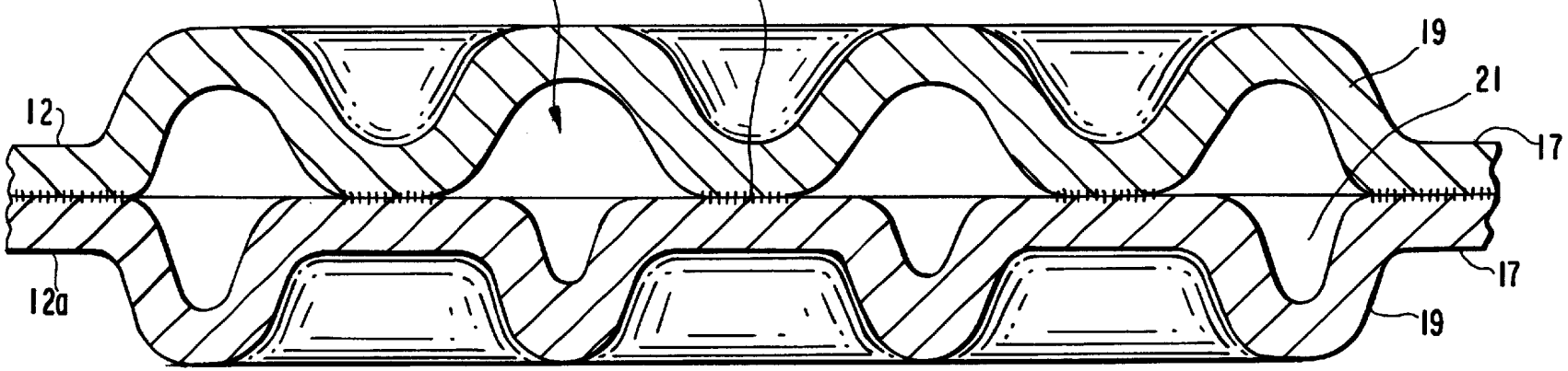

FIG. 9 is an enlarged detail cross-sectional view of a portion of the plates composing each of the series of plates of the cooling device of this invention taken along lines 9—9 of FIG. 5.

Figure 10:
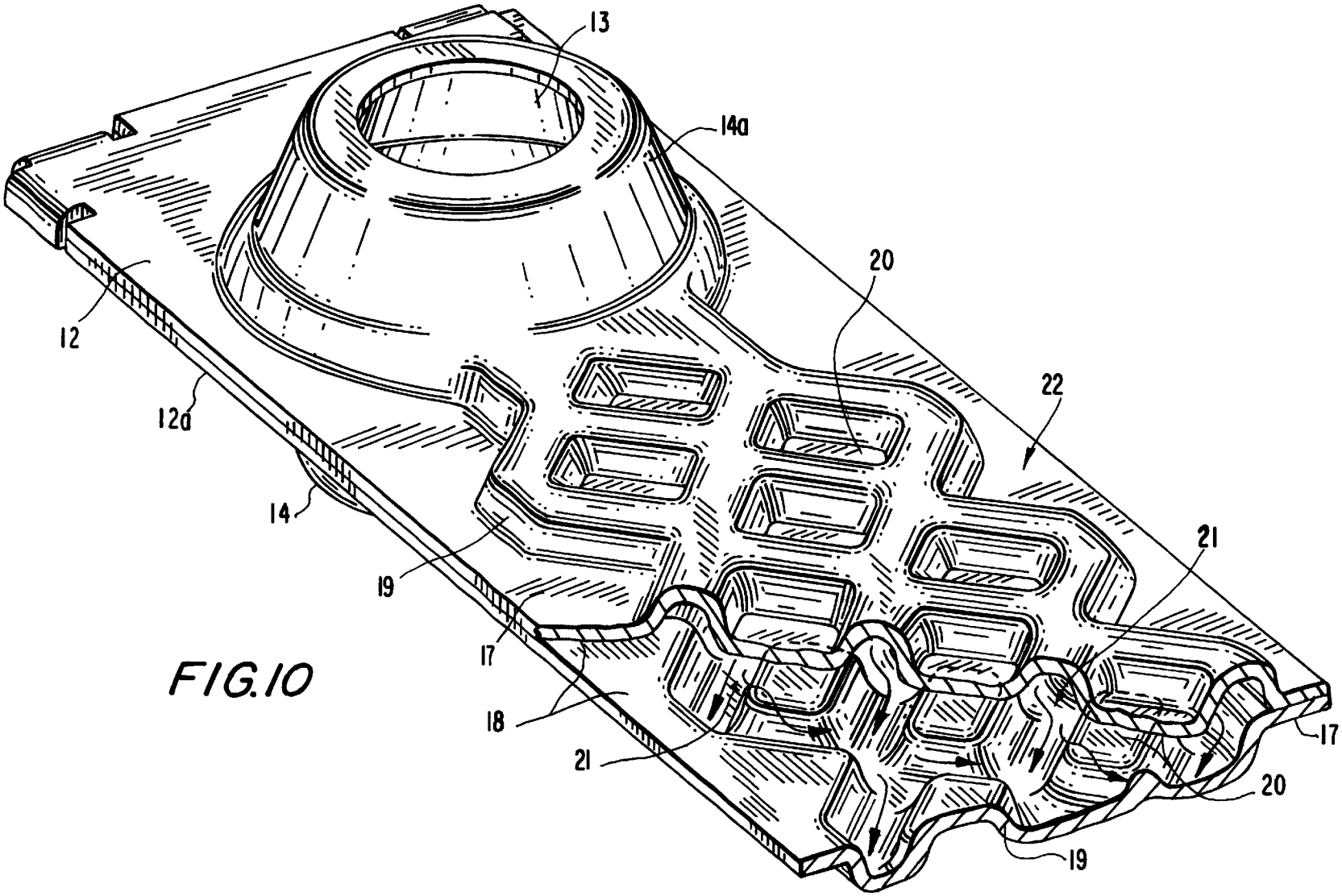

FIG. 10 is a perspective view of a portion of the plates composing each of the series of plates of the cooling device of this invention with portions of the Figure broken away with directional arrows showing the path that the fluid to be cooled passes through the channel provided outside of the abutting baffle members of each of the series of plates.

The invention will now be further described by reference to the specific embodiment thereof shown in the accompanying drawings which represents the best mode known to the applicant to carry out the present invention.

The fluid cooling device 10 of this invention includes a plurality of spaced series of plates 11. Each of said series 11 is composed of a pair of longitudinal plates 12 and 12*a*. Plate 12 is designated as the upper plate and plate 12*a* is designated as the lower plate in this specification. Each of plates 12 and 12*a* of each of said series of plates 11 is provided with a first opening 13 at one longitudinal end portion and a second opening 13*a* at the opposite longitudinal end portion. Surrounding each of the first openings 13 at the first end portion of each of plates 12 of each of the series of plates 11 is a depending portion 14 and surrounding each of the first openings 13 at the corresponding first end portion of plate 12*a* is a projecting portion 14*a*. Portions 14 and 14*a* are designed to abut one another when plates 12 and 12*a* are assembled into the device of this invention. All of the first openings 13 within the first end portion of each of plates 12 and 12*a* of each of said series 11 of said plates are in registration with one another and define an inlet channel 15. Surrounding each of the second openings 13*a* at the opposite second longitudinal end of each of plate 12 of each of the series of plates 11 is a depending portion 7 and surrounding each of the openings 13*a* at the corresponding opposite longitudinal second end portion of plate 12*a* is a projecting portion 8. Portions 7 and 8 abut each other when the device of this invention is assembled. The openings 13*a* at the opposite end portion of each of plates 12 and 12*a* are also in registration with one another and define an outlet channel 16.

Figure 3:
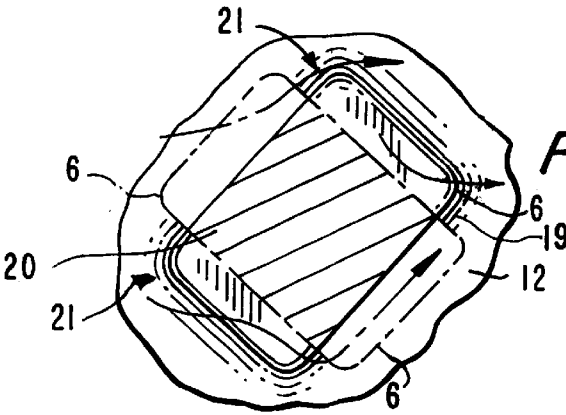
FIG. 3 is an enlarged detail cross-sectional view of a pair of abutting baffle members of this invention showing their preferred rectangular cross-sectional construction and the manner in which the two abutting baffle members lie above one another.
Figure 4:
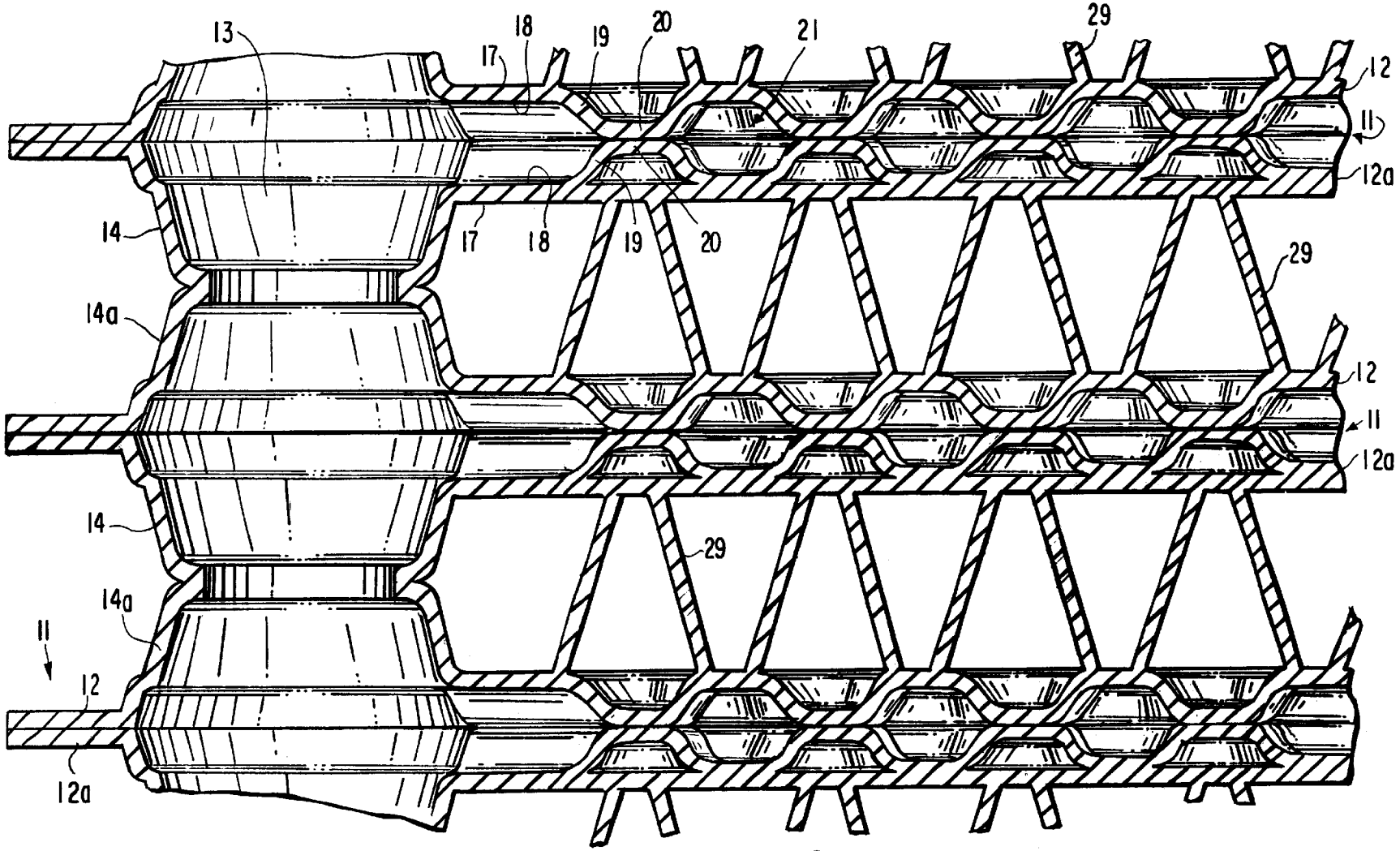
FIG. 4 is an enlarged sectional view, taken along line 4 of FIG. 2, showing one end portion of the cooling device of this invention including one end portion of the plates, the projecting member at one end of the plates, and the cooling fins between adjacent plates. The opposite end structure is identical to the structure shown.

Each of plates 12 and 12*a* has an outer face 17 and an inner face 18. Inner face 18 carries a plurality of integral upstanding spaced baffle portions 19 which are formed by punching in the corresponding portions 20 of the outer face 17 of each of plate members 12 and 12*a*. These baffle portions 19 are preferably made rectangular in cross section with rounded corner portions 6 as shown in FIG. 3. Each of the separate baffle portions 19 are offset from one another as shown in FIGS. 2,5,7 and 8. Each series of plates 11 consists of a pair of plate members 12 and 12*a* lying one on top of the other when the device is assembled with the projecting baffle portions 19 of plate 12 and the corresponding projecting baffle portions 19 of plate 12*a* thereof abutting one another. The abutting baffle members 19 of each of the plates 12 and 12*a* of each series 11 of plates 12 and 12*a* are formed into a plurality of series of baffle members 22 with each of series 22 being offset from the adjacent series. Preferably, also, the members of each baffle series 22 are also offset from one another. The portions of baffle members upon plates 12 and 12*a* which do not abut each other define a channel 21 therewithin. Channel 21 extends from openings 13 to openings 13*a* and communicate with both openings 13 which define the inlet channel 15 and openings 13*a* which define the outlet channel 16 respectively.

Channel 15 is open at one end 23 thereof and closed at its opposite end 24 and channel 16 is also open at one end 25 thereof and closed at the opposite end 26.

An inlet tube 27 communicates with inlet channel 15 and an outlet tube 28 communicates with outlet channel 16.

Cooling fins 29 are disposed between each series 11 of plate members 12 and 12*a* and are secured between the said series of plate members.

An upper spacer plate 30 is also provided which also contains a first opening 31 at one end thereof and a second opening 31*a* at its opposite end thereof, Opening 31 of plate 30 is in registration with opening 13 and opening 31*a* of plate 30 is in registration with opening 13*a*.

An upper securing plate 32 is also provided which overlies spacer plate 32 and is provided with a first opening 33 at one longitudinal end thereof and a second opening 33*a* at its opposite longitudinal end thereof. Opening 33 is in registration with openings 13 and opening 33*a* is in registration with openings 13*a*.

Upper securing plate 32 is also provided with additional openings 34 which are adapted to accommodate appropriate fastening means to secure the device in place.

Figure 1:
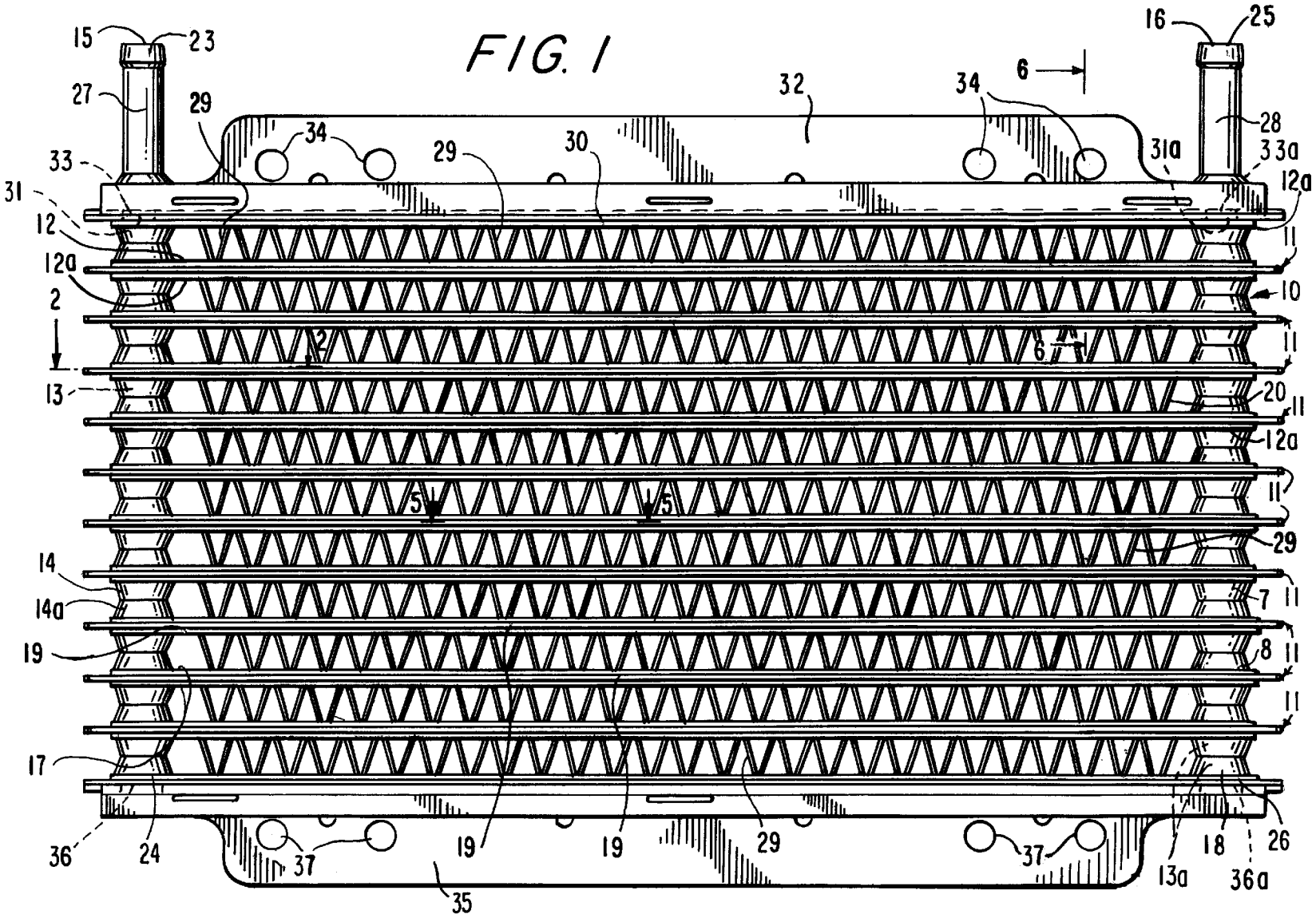
Figure 2:
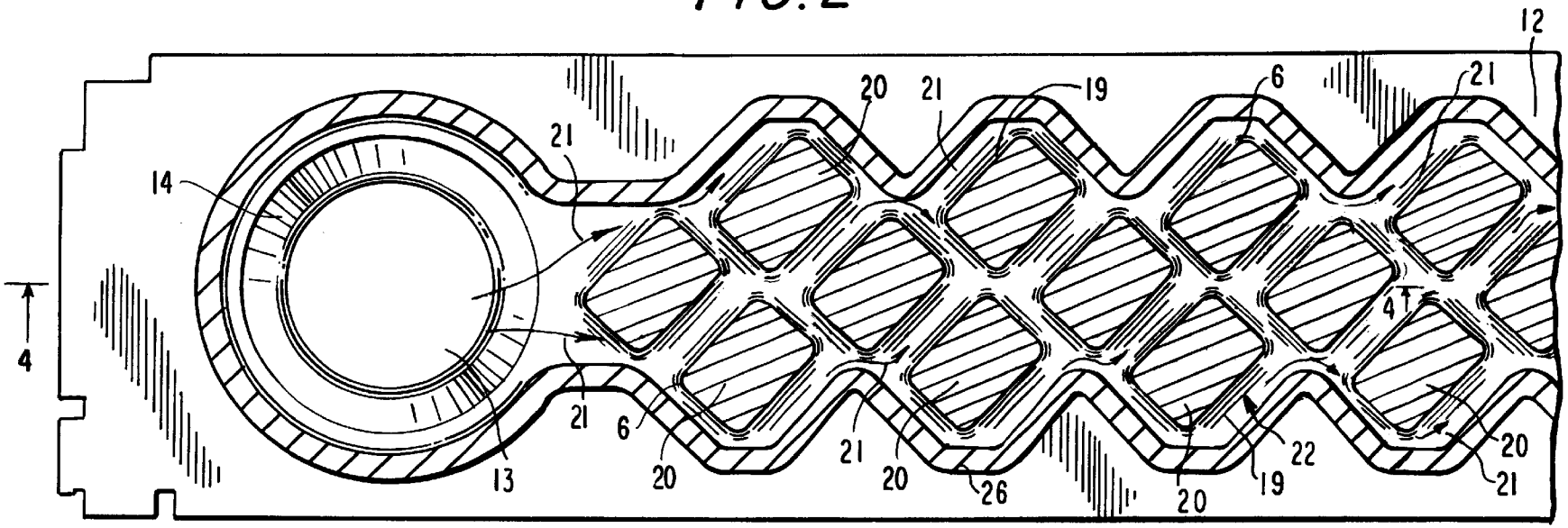

A lower securing plate 35 (FIG. 1) is provided with a first opening 36 at one longitudinal end thereof in registration with opening 13 and a second opening 36*a* at its opposite longitudinal end thereof which is in registration with opening 13*a*. Lower securing plate 35 also is provided with second openings 37 in order to permit it to be secured in place by appropriate fastening means.

Cooling fins 29 are disposed between adjacent series of plates and are secured thereto by appropriate securing means such as brazing, soldering, etc.

With the foregoing description the operation of this device can now be explained.

Fluid to be cooled is passed into the cooling device under external pressure produced by a pressure device such as an oil pump through the inlet tube 27 and into inlet channel 15. It is noted that the inlet opening of the device and the outlet opening of the device are interchangeable with respect to the direction of fluid flow and the fluid to be cooled can selectively flow at the discretion of the operator of the device either through the inlet opening and out of the outlet opening or into the outlet opening and out of the inlet opening.

In the specific example discussed herein the direction of fluid flow being utilized in this discussion is inlet tube 27 which is provided with an inlet opening 23. The fluid to be cooled enters inlet tube 27 through opening 23 and enters the inlet channel 15. The fluid then passes through each of channels 21 and thence into outlet channel 16 and out through the outlet tube 28 which is provided with outlet opening 25.

Because the fluid also strikes the baffle members 18 while passing through channels 21 it is subjected to turbulence. The turbulence is caused by the flow of the fluid against the baffle members. Since the baffle members of this invention are rectangular rather than circular the perimeter of the rectangle is larger than the circumference of a circle the fluid to be cooled is in contact with a relatively larger surface area than would be involved with circular baffle members. The larger the surface area that the liquid to be cooled comes into contact the more heat can be removed by the plate members and the cooling fins.

The fact that the baffle members are integral with the plates and that the baffle members of each plate of the series of plates are in abutting relationship with one another also causes the structure to be far better able to withstand the pressure of the fluid passing therethrough. Firstly the unsupported area between the plates involved is reduced by the presence of the baffle members. Secondly the baffle members extending between the plates also provides additional support.

Because of the offset position of the baffle members when the upper plate is connected to the lower plate and the baffle members of each plate are abutting one another the abutting portions of the plate members do not precisely match. As a result a portion of the fluid passing through the plate members also flows above the non abutting portions of the baffle members. This provides for increased turbulence and improved cooling of the fluid passing through the device.

The offset position of the baffle members is further advantageous because the baffle members are offset from one another. The cascading pattern of the fluid to be cooled is thus different along the two perpendicular sides of the baffle members. Because of the difference in the cascading pattern involved substantial additional turbulence is produced.

Additionally where an external pressure producing device is utilized in connection with the cooling device of this invention a significant pressure drop occurs as the fluid passes through the device thus producing inefficiency in cooling action. Conventionally this is compensated for by providing additional fluid passageways which contributes to increased manufacturing cost. In the present invention, because of the construction involved, it is possible to increase the spacing between the two plates comprising each series of plates and therefore minimizing the pressure drop involved.

The foregoing description shows how the objects of this invention are achieved.

The reader is further informed that the specific structure shown in this specification of this invention is for purposes of illustration and for example only. Other changes and modifications could be made within the spirit and scope of this invention in accordance with the claims herein.

I claim:

1. A fluid cooling device composed of, a plurality of series of longitudinal plates spaced from one another, each of said series of longitudinal plates consisting of an first longitudinal plate and a second longitudinal plate overlying one another, said first longitudinal plate having a first depending portion at a longitudinal end portion thereof and a second depending portion at its opposite longitudinal end portion thereof, said second longitudinal plate having a first projecting portion at a longitudinal end portions thereof and a second projecting portion at its opposite longitudinal end thereof, said first depending portion of said first longitudinal plate and said first projecting portion of said second longitudinal plate abutting one another and said second depending portion of said first longitudinal plate and said second projecting portion of said second longitudinal plate abutting one another, each of said abutting first depending and projecting portions of said plates provided with first openings therewithin in registration with one another and each of the second abutting and projecting portions of said plates provided with second openings therewithin in registration with one another, the first openings in each of the plates of each of the series of plates being in registration with one another and defining an inlet channel, and the second openings in each of the plates of each of the series of plates being in registration with one another and defining an outlet channel, said first plate and said second plate of each of said series of plates, each having an outer face and an inner face, the outer faces of each of said first and second plates having a plurality of spaced depressions and the inner faces of each of said plates having a plurality of integral upstanding baffle members formed by creating the depressed portions of the lower face of each of said plates, said baffle members being transversely spaced from one another, the upstanding baffle members of the first plate and the second plate overlying and abutting one another, the spaced portions of the first and second plates defining a channel communicating at one end portion with said inlet channel and communicating at its opposite end portion with said outlet channel.

2. A fluid cooling device as described in claim 1 including a first support member connected to the upper end of said device and a second support member connected to the lower end of said device.

3. A fluid cooling device as described in claim 2 said plate members being formed into a plurality of spaced series with each series thereupon also spaced from one another.

* * * * *